US010760364B2

(12) United States Patent
Johnson et al.

(10) Patent No.: US 10,760,364 B2
(45) Date of Patent: Sep. 1, 2020

(54) MILLING TOOL AND METHOD

(71) Applicant: SCHLUMBERGER TECHNOLOGY CORPORATION, Sugar Land, TX (US)

(72) Inventors: Ashley Bernard Johnson, Cambridge (GB); Jonathan Robert Hird, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 67 days.

(21) Appl. No.: 15/553,625

(22) PCT Filed: Feb. 18, 2016

(86) PCT No.: PCT/US2016/018554
§ 371 (c)(1),
(2) Date: Aug. 25, 2017

(87) PCT Pub. No.: WO2016/137822
PCT Pub. Date: Sep. 1, 2016

(65) Prior Publication Data

US 2018/0045009 A1 Feb. 15, 2018

(30) Foreign Application Priority Data

Feb. 27, 2015 (GB) ..... 1503380.6

(51) Int. Cl.
*E21B 29/00* (2006.01)

(52) U.S. Cl.
CPC ..... *E21B 29/005* (2013.01); *E21B 29/002* (2013.01)

(58) Field of Classification Search
CPC .... E21B 29/002; E21B 29/005; E21B 10/322; E21B 10/32; E21B 29/06
See application file for complete search history.

(56) References Cited

U.S. PATENT DOCUMENTS 1,801,482 A * 4/1931 Boynton ..... E21B 10/003 166/55.8
3,283,405 A * 11/1966 Braswell ..... E21B 29/005 30/103

(Continued)

FOREIGN PATENT DOCUMENTS

EP 0385673 A1 9/1990
EP 0397417 A1 11/1990

(Continued)

OTHER PUBLICATIONS

Sinor, L. A. et al., "Application of Anti-Whirl PDC Bits Gains Momentum", SPE 25644, presented at the SPE Middle East Oil Technical Conference Exhibition, Bahrain, 1993, pp. 395-403.

(Continued)

*Primary Examiner* — Kipp C Wallace

(57) ABSTRACT

Tubing in a borehole is removed using a rotary milling tool comprising a plurality of elements projecting from or extensible from the body of the tool. The elements are distributed azimuthally around the tool body. The elements comprise cutters to remove material from the tubing and outward facing guide surfaces for sliding contact with an inner surface of the tubing. As the tool is rotated and advanced, forward cutters contact the inner surface removing material from the tubing and exposing a renewed interior tubing surface with a diameter swept out by the cutter. The outward facing guide surfaces extend the same distance from the tool body as the forward cutters producing a sliding contact with the newly created inward facing surface. Further cutters, disposed behind the outward facing guide surfaces, with respect to motion of the tool through the tubing, remove the remaining portion of the tubing.

15 Claims, 10 Drawing Sheets

(56) References Cited

U.S. PATENT DOCUMENTS

| | | | | |
|---|---|---|---|---|
| 4,710,074 | A | 12/1987 | Springer | |
| 4,887,668 | A | 12/1989 | Lynde et al. | |
| 5,070,952 | A * | 12/1991 | Neff | E21B 10/322 166/55.7 |
| 5,265,675 | A * | 11/1993 | Hearn | E21B 10/322 166/297 |
| 5,456,312 | A * | 10/1995 | Lynde | B23B 5/16 166/55.6 |
| 6,386,302 | B1 | 5/2002 | Beaton | |
| 6,732,817 | B2 | 5/2004 | Dewey et al. | |
| 6,920,923 | B1 | 7/2005 | Pietrobelli et al. | |
| 7,954,564 | B2 | 6/2011 | Makkar et al. | |
| 9,187,960 | B2 | 11/2015 | Radford et al. | |
| 10,167,690 | B2 * | 1/2019 | Haq | E21B 29/005 |
| 2004/0134687 | A1 | 7/2004 | Radford et al. | |
| 2004/0159468 | A1 | 8/2004 | Hoffmaster et al. | |
| 2010/0276145 | A1 * | 11/2010 | Dewey | E21B 7/061 166/298 |
| 2012/0152543 | A1 * | 6/2012 | Davis | E21B 10/66 166/298 |
| 2012/0325480 | A1 * | 12/2012 | Schmidt | E21B 29/005 166/298 |
| 2013/0146361 | A1 * | 6/2013 | Makkar | E21B 10/322 175/57 |
| 2013/0153306 | A1 | 6/2013 | Burhan et al. | |
| 2013/0199785 | A1 * | 8/2013 | Hekelaar | E21B 23/006 166/298 |
| 2014/0262523 | A1 * | 9/2014 | Davis | E21B 10/322 175/57 |
| 2015/0376966 | A1 * | 12/2015 | Balasubramanian | E21B 29/005 166/298 |
| 2019/0071930 | A1 | 3/2019 | Hird et al. | |

FOREIGN PATENT DOCUMENTS

| | | | |
|---|---|---|---|
| GB | 2528454 | A | 1/2016 |
| GB | 2528457 | A | 1/2016 |
| GB | 2528459 | A | 1/2016 |
| WO | 2013134629 | A1 | 9/2013 |
| WO | 2015054227 | A2 | 4/2015 |
| WO | 2016014283 | A1 | 1/2016 |

OTHER PUBLICATIONS

Search Report and Written Opinion of International Patent Application No. PCT/US2017/014484, dated May 1, 2017, 16 pages.

International Preliminary Report on Patentability of International Patent Application No. PCT/US2017/014484, dated Aug. 2, 2018, 12 pages.

Search Report under Section 17(5) of UK Patent Application No. 1601130.6, dated Feb. 16, 2016, 5 pages.

Search and Examination Report R 62 EPC in European Patent Application No. 17742086.6, dated Aug. 1, 2019, 8 pages.

Search Report and Written Opinion of International Patent Application No. PCT/US20161042697, dated Oct. 14, 2016, 16 pages.

International Preliminary Report on Patentability of International Patent Application No. PCT/US2016/042697, dated Jan. 25, 2018, 13 pages.

Search Report and Written Opinion of International Patent Application No. PCT/US2016/041810, dated Oct. 20, 2016, 15 pages.

International Preliminary Report on Patentability of International Patent Application No. PCT/US2016/041810, dated Jan. 25, 2018, 12 pages.

International Preliminary Report on Patentability of International Patent Application No. PCT/US2016/018554, dated Sep. 8, 2017, 9 pages.

Combined Search and Examination Report under Sections 17 and 18(3) of UK Patent Application No. 1503380.6, dated May 20, 2015, 6 pages.

* cited by examiner

MILLING TOOL AND METHOD

BACKGROUND

In the hydrocarbon exploration and production industry, a milling tool, which is commonly referred to as a section mill, may be used to remove a length of metal tubing within a borehole, by comminuting the tubing to swarf. Merely by way of example, one circumstance in which milling is used is when removing tubing/casing and exposing the rock formation around a borehole in preparation for setting a cement plug to meet regulatory requirements when a well is abandoned.

A conventional section mill, such as the K-Master section mill supplied by Schlumberger, is incorporated into a drillstring which extends up to the surface and also extends forwardly beyond the section mill itself. The portion of the drill string which extends forwardly from the section mill includes components which are dimensioned to have an exterior diameter slightly smaller than the interior diameter of the tubing which is to be removed. These components locate the axis of the drillstring relative to the axis of the tubing which is to be milled.

In many instances, the cutting blades of a conventional section mill can be expanded outwards relative to the body of the tool. The ability to expand allows the mill to be inserted along the tubing to a desired starting point and then to cut outwards through the tubing before being advanced axially to extend the length of tubing which is being removed.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth.

Disclosed now is a tool and method for removing tubing within a borehole. In embodiments of the present disclosure, the rotary tool comprises a plurality of elements that project out from the body of the tool while it is in operation and these elements carry guide surfaces that are able to make sliding contact with an interior surface created on the tubing by a cutter or cutters positioned on the tool axially ahead of the guide surfaces. By creating the interior surface using one or more cutters, the diameter of the surface is controlled and the guide surfaces can then be positioned as a close fit against this surface, giving stable positioning of the tool relative to the tubing being milled.

In one aspect of embodiments of the present disclosure there is disclosed here a rotary milling tool for removing tubing in a borehole, where the milling tool comprises a tool body and a plurality of elements projecting from or extensible from the tool body and distributed azimuthally around a longitudinal axis of the tool body. If the elements are extensible then means are provided for extending the elements from the tool body. At least some of the elements have outward facing guide surfaces that make sliding contact with an inward facing surface of the tubing in the borehole. And at least some of the elements comprise cutters to remove material from the tubing, where at least some of these cutters are configured to produce the inward facing surface that is contacted by the guide surfaces.

The cutters and guide surfaces are provided in a configuration in which a plurality of the outward facing guide surfaces are distributed azimuthally around the tool axis. At least one cutter is positioned as a leading cutter at an axial position that is at least as far forward in the direction of advance of the tool to provide that the cutter creates the inward facing surface in front of the guide surface, with respect to the motion of the tool. This cutter extends radially outward from the tool axis to a same distance/extent as the plurality of guide surfaces. At least one further cutter is positioned to follow axially behind the plurality of guide surfaces and this cutter extends radially outwards beyond the guide surfaces to provide for further cutting of the tubing behind the guide surface as the tool is moved axially through the tubing.

In some embodiments the cutters and guide surfaces may be disposed on a milling block and the milling tool may comprise a plurality of these milling blocks disposed around a circumference (circumferentially) of the milling tool. The milling blocks may comprise a forward cutter that extends outwards from the surface of the milling block and is configured to cut/mill a surface on the tubing. In use, the milling block may be extended from the tool body to mill the surface on the tubing. The extent of the cut of the cutter into the tubing defines a drilling silhouette. A guide surface extend from the milling block to the same extent as the forward cutter to provide that in use the guide surface extends to the cutting silhouette of the forward cutter. A trailing cutter is positioned behind the guide surface and extends beyond the guide surface so that in use the trailing cutter cuts/mills the tubing beyond the cutting silhouette of the forward cutter.

In some embodiments, the plurality of outward facing guide surfaces may be at the same axial position on the tool although distributed azimuthally around it. In some embodiments, the plurality of outward facing guide surfaces are not identical to one another and/or only some of the plurality of outward facing guide surfaces are identical.

In some embodiments, the plurality of guide surfaces are provided on three or more elements projecting from or extensible from the tool body and distributed azimuthally around the tool axis. These three or more elements may be disposed at the same axial position on the tool. These elements, which according to embodiments of the present disclosure, each have an outwardly facing guide surface may each have at least one leading cutter ahead of the guide surface and with the same radial extension from the tool as the guide surface, and at least one further cutter located axially behind the guide surface and extending radially outwards beyond the guide surface. In some embodiments, there may be more than one plurality of guide surfaces at different axial positions on the tool, with increasing radial distances from the tool axis and each with at least one leading cutter which extends out from the tool axis to the same distance as the guide surfaces.

In a second aspect of embodiments of the present disclosure there is disclosed here a method for removing a length of tubing in a borehole inserting a rotary milling tool into the tubing, where the milling tool comprises a tool body and a plurality of elements which project from or are extensible from the tool body. The plurality of elements are distributed azimuthally around a longitudinal axis of the tool body. At least some of the elements have outward facing guide surfaces for sliding contact with an inward facing surface of the tubing in the borehole and at least some of the elements comprise one or more cutters to remove material from the tubing. At least one cutter is positioned as a leading cutter at an axial position which is at least as far forward in the direction of advance of the tool as the axially leading parts/sections/edges of the guide surfaces and extends radially out from the tool axis to the same distance as the guide surfaces. And at least one further cutter is positioned axially behind the guide surfaces and extends radially outwards beyond the guide surfaces.

In embodiments where the elements are extendable from the tool body, the elements may be extended outwards during operation. In the method, the tool is rotated and advanced axially through the tubing. This motion provides for the at least one leading cutter contacting the interior surface of the tubing and removing material from the interior surface of the tubing and expose a new or renewed interior tubing surface with diameter swept out by the at least one cutter. The outward facing guide surfaces on a plurality of the azimuthally distributed elements makes a sliding type contact with the new or renewed interior surface as the tool is advanced through the tubing. Behind the outward facing guide surfaces, the new or renewed interior surface is removed by contacting it and cutting it with the at least one further cutter as the tool advances.

Using the tubing, which is about to be removed in the milling process, as a guide for components dimensioned to have an exterior diameter smaller than the interior diameter of that tubing leads to inaccuracy in the positioning of the tool and undesirable vibration. However, an obstacle to using the tubing as a guide when milling tubing which is in a borehole is that the interior of the tubing may not be of uniform diameter because it may have become corroded, have some form of detritus accumulated on it and/or the like.

In embodiments of the present disclosure, one or more leading cutters are used to expose a new or renewed inward facing tubing surface which can be contacted by the outward facing guide surfaces to give more accurate positioning of the tool as it is advanced and cuts into the tubing. This surface which is exposed may be a renewed surface at approximately the internal diameter of the tubing when it was new, in other words a refreshed internal surface of the tubing. Another possibility is that the leading cutter(s) may remove some of the original metal from the inside of the tubing, as well as any corrosion or accumulated material, thus reducing the tubing thickness. In this case the newly exposed internal surface of the tubing is a new surface with an internal diameter which is greater than the original internal diameter of the tubing.

Furthermore, although this new or renewed internal surface provides a guide for the positioning the tool, it has only a transient existence. As the tool advances, the further cutters which follow axially behind the guide surfaces cut into and remove the remaining metal of the tubing. Further, the configuration provides for separated stages of cutting with a stabilizing section, the guide surface, between cutting stages, which may provide for stabilizing the cutting tool. In some embodiments, different areas of stabilizing sections may be used to provide stabilization.

For the tool and method described above, it is possible that some or all of the projecting elements may be fixed relative to the tool body. A tool with fixed elements may be used to mill tubing where it is possible to begin at an end of the tube, which of course would require the end to be accessible to the tool. However, in some forms of the tool, the elements are extensible from the tool body by operation of a drive mechanism. The tool may then be inserted into tubing with the elements retracted and when the tool is at the position where milling is to start, the elements are extended by operation of the drive mechanism and cut outwards into the tubing as they are extended.

When the cutters cut into the tubing and remove tubing metal, this tubing metal is reduced to swarf and so the tubing is destroyed by comminuting it. The further cutters may also extend radially outwards beyond the tubing and then they may remove some non-metallic material which was outside the tubing. More specifically they may remove some or all of any cement around the exterior of the tubing and possibly even some formation rock.

As stated above, the tool has projecting or extensible elements distributed azimuthally around it. For instance, in some embodiments, there may be three or four elements with guide surfaces at 120° or 90° azimuthal intervals around the tool body. In other embodiments, more elements may be used. Each one of at least three elements at the same axial position relative to the tool may have a guide surface at the same radial distance from the tool axis. It is possible that some elements may comprise cutters while other elements provide guide surfaces. It is also possible that some elements comprise leading cutters and guide surfaces while other elements provide the further cutters axially following the guide surfaces. In some forms of rotary tool all the projecting or extensible elements comprise leading cutters, further cutters and guide surfaces between them.

Cutters on the projecting or extensible elements, both leading cutters and further cutters following axially behind the guide surfaces may comprise a hard material. For example tungsten carbide is a material which is commonly used for cutters because it is very hard and also has good thermal stability. Other hard materials which may be used are carbides of other transition metals, such as vanadium, chromium, titanium, tantalum and niobium. Silicon, boron and aluminium carbides are also hard carbides. Some other hard materials are boron nitride and aluminium boride. A hard material may have a hardness of 1800 or more on the Knoob scale or a hardness of 9 or more on the original Mohs scale (where diamond has a Mohs hardness of 10). Cutters of hard material may be made as ceramic objects, with particulate hard material embedded in a matrix of another material which may be a metal or metal alloy. Cutters of this form may be attached by brazing to a projecting or extensible structure which is steel.

When the tool has expandable elements, the drive for their expansion may in some embodiments be powered hydraulically by fluid pumped from the surface. The drive may be arranged to expand a plurality of elements, distributed azimuthally around the tool body, in unison. The travel of the elements as they are expanded may be a motion around a pivotal attachment to the tool body or it may be a motion in which the elements move outwardly without changing their orientation relative to the tool body. The latter may be brought about by constraining each element to be movable along a pathway. More specifically pathways may be angled relative to the tool axis and configured so that when the elements are moved axially they also move outwardly in unison.

The length of tubing which is removed by the tool and method above may be considerable. It may for example be a length which is many times (for instance more than 10 times) greater than the axial length taken up by of the cutters and guide surfaces of the tool itself. The length of tubing removed may be 5 metres or more. The removal of tubing may be carried out for various reasons, but in some instances it may be done before plugging and abandoning the borehole.

BRIEF DESCRIPTION OF DRAWINGS

The present disclosure is described in conjunction with the appended figures. It is emphasized that, in accordance with the standard practice in the industry, various features are not drawn to scale. In fact, the dimensions of the various features may be arbitrarily increased or reduced for clarity of discussion.

Figure 1:
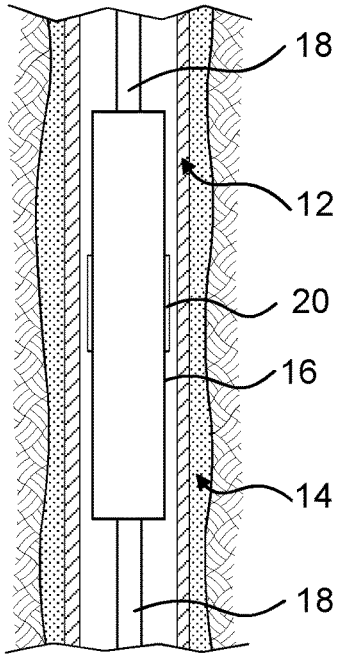
FIGS. 1, 2 and 3 schematically illustrate a task performed by a milling tool.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but may have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
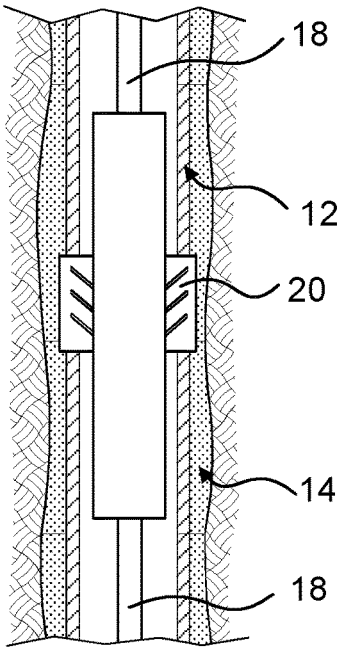
Figure 3:
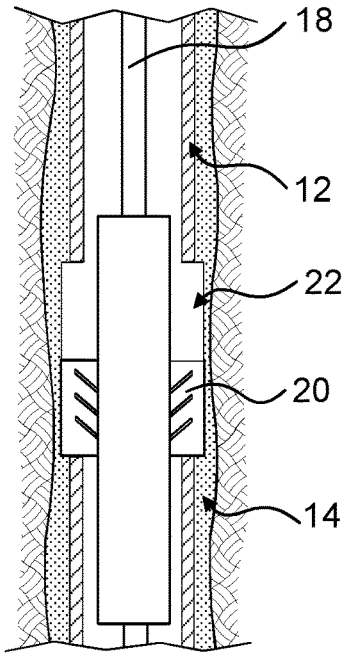

FIGS. 1 to 3 show a function which has conventionally been performed with a section mill and which may be performed by a milling tool and method as disclosed herein.

As shown by FIG. 1 an existing borehole is lined with tubing 12 (the wellbore casing) and cement 14 has been placed between the casing and the surrounding rock formation. The tubing and cement may have been in place for some years. It is now required to remove a length of tubing, starting at a point below ground. One possible circumstance in which this may be required is when a borehole is to be abandoned, and regulatory requirements necessitate removal of a length of tubing and surrounding cement in order to put a sealing plug in place.

As shown by FIG. 1 a milling tool 16 is included in a drillstring 18 which is lowered into the borehole. This drill string can be formed from conventional drill pipe which is able to convey drilling fluid down to the milling tool 16 and which is rotatable by a drive motor at the surface. In an alternative arrangement (not shown) the milling tool may be attached to a hydraulic motor attached to coiled tubing inserted into the borehole.

When the milling tool 16 has been inserted to the desired depth in the borehole, cutters 20, represented diagrammatically as rectangles in FIGS. 1 to 3 are expanded from the tool body as the tool is rotated. The cutters 20 cut outwards, into and through the tubing. The fully expanded cutters extend beyond the tubing into the surrounding cement 14.

Once the cutters have been fully expanded, the rotating drillstring is advanced axially down the borehole, removing tubing and some of the surrounding cement. As the tool is advanced axially downhole, the cavity 22 above it has the diameter swept out by the extended cutters 20 and is larger than the outside diameter of the tubing which is being removed.

Figure 4:
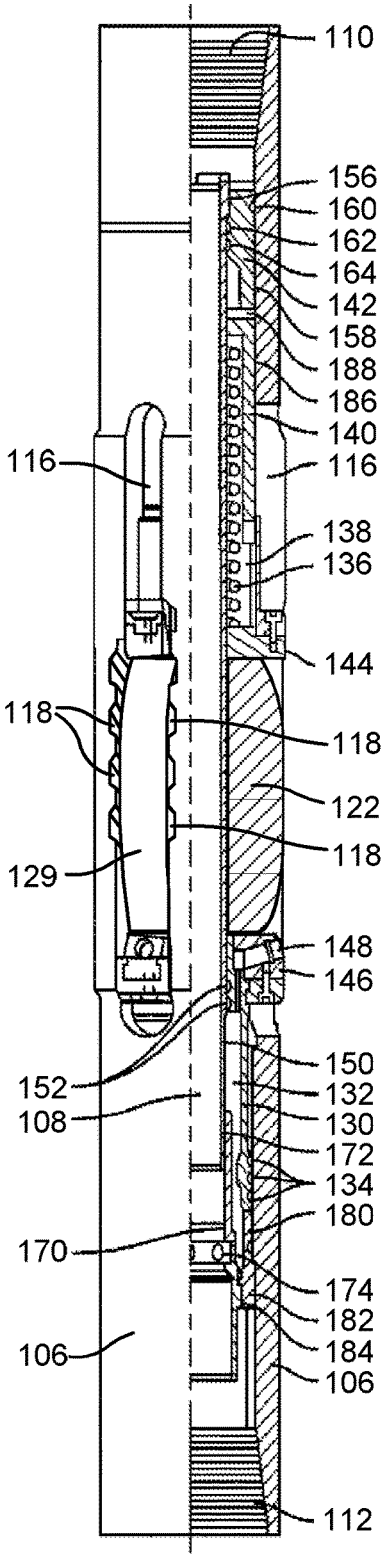
FIG. 4 is a cross-sectional elevation view of an expandable tool, in accordance with embodiments of the present disclosure, showing its expandable blades in retracted position.
Figure 5:
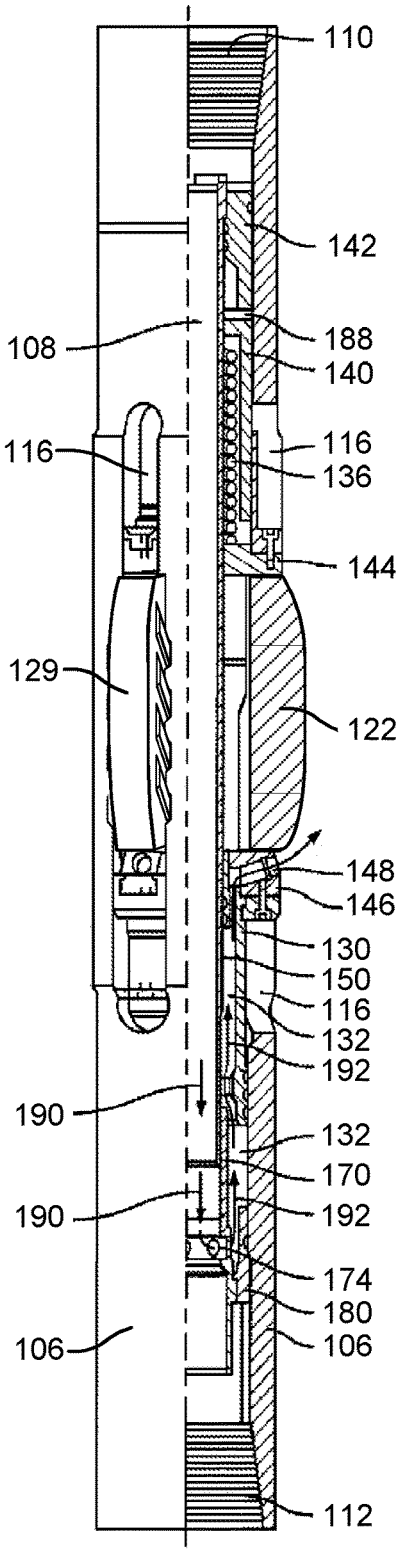
FIG. 5 is a cross-sectional elevation view of the expandable tool of FIG. 4, showing the blades in expanded position.
Figure 6:
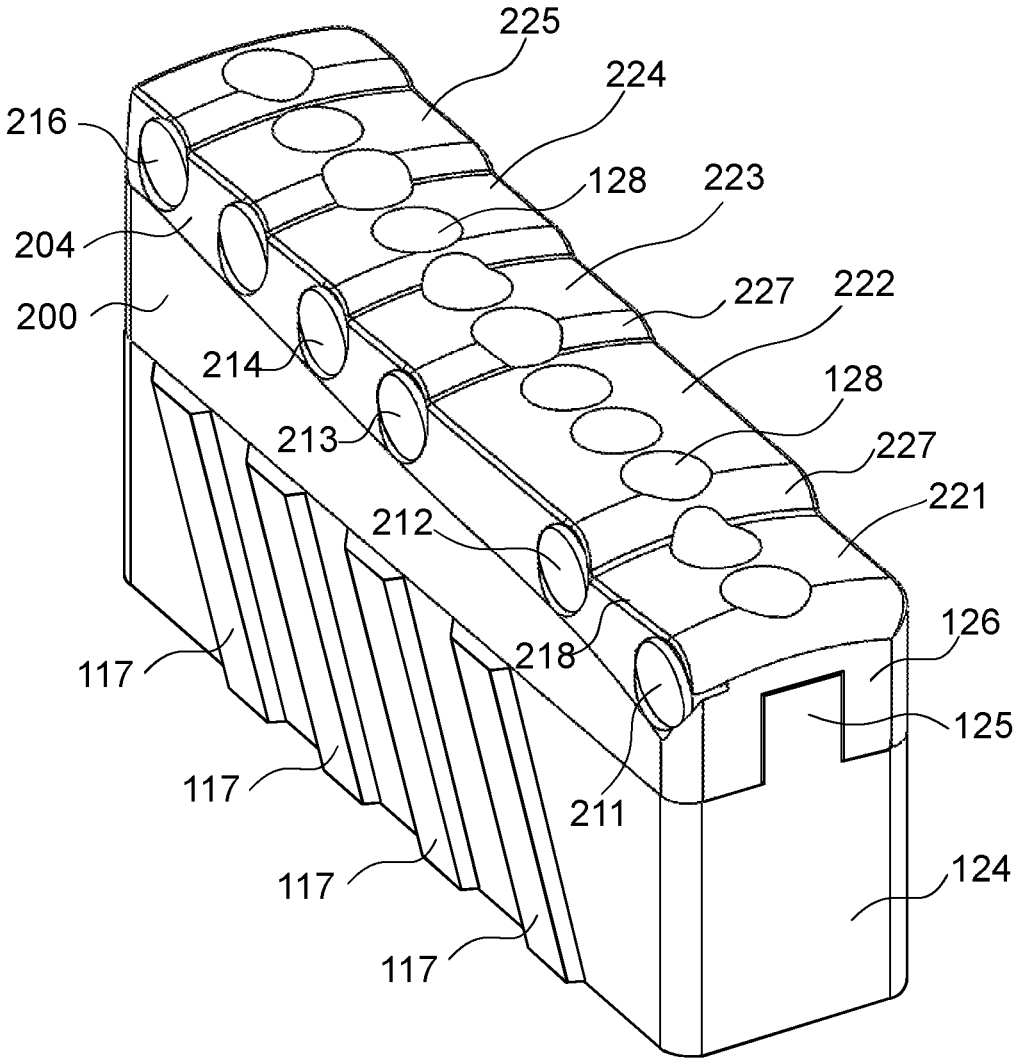
FIG. 6 is a perspective view of a cutter block for the expandable reamer of FIGS. 4 and 5.

A milling tool embodying the concepts disclosed here may be implemented using a tool body and expansion system of a type currently used in some under-reamers. Such an embodiment is shown by FIGS. 4-6. FIG. 4 shows the tool body and expandable cutter blocks with the blocks in retracted position. FIG. 5 is a corresponding view with the blocks in expanded position.

This expandable tool comprises a generally cylindrical tool body 106 with a central flowbore 108 for drilling fluid. The tool body 106 includes upper 110 and lower 112 connection portions for connecting the tool into a drilling assembly. Intermediately between these connection portions 110, 112 there are three recesses 116 formed in the body 106 and spaced apart at 120° intervals azimuthally around the axis of the tool.

Each recess 116 accommodates a cutter block 122 in its retracted position. The three cutter blocks are identical in construction and dimensions. One such cutter block 122 is shown in perspective in FIG. 4. The block 122 is formed of a steel inner block part 124 with a projecting lug 125 along its outer surface and an outer block part 126 astride the lug 125 and bolted to the inner part 124 by bolts (not shown) inserted through the apertures 128 into threaded holes in the inner part 124. Details of the outer part 126 are not shown in FIGS. 4 and 5 and will be described in more detail below. The outer face 129 of the outer block part 126 is indicated without detail in FIGS. 4 and 5.

The inner block part 124 has side faces with protruding ribs 117 which extend at an angle to the tool axis. These ribs 117 engage in channels 118 at the sides of a recess 116 and this arrangement provides a pathway which constrains motion of each cutter block such that when the block 122 is pushed upwardly relative to the tool body 106, it also moves radially outwardly to the position shown in FIG. 5 in which the blocks 122 project outwardly from the tool body 106. It will be appreciated that each cutter block is constrained by the ribs 117 in channels 118 to move bodily upwardly and outwardly without changing its orientation (i.e. without changing its angular position) relative to the tool axis.

A spring 136 biases the block 122 downwards to the retracted position seen in FIG. 4. The biasing spring 136 is disposed within a spring cavity 138 and covered by a spring retainer 140 which is locked in position by an upper cap 142. In some embodiments, the spring may comprise a complaint/elastic material. A stop ring 144 is provided at the lower end of spring 136 to keep the spring in position.

Below the moveable blocks 122, a drive ring 146 is provided that includes one or more nozzles 148. An actuating piston 130 that forms a piston cavity 132 is attached to the drive ring 146. The piston 130 is able to move axially within the tool. An inner mandrel 150 is the innermost component within the tool, and it slidingly engages a lower retainer 170 at 172. The lower retainer 170 includes ports 174 that allow drilling fluid to flow from the flowbore 108 into the piston chamber 132 to actuate the piston 130.

The piston 130 sealingly engages the inner mandrel 150 at 152, and sealingly engages the body 106 at 134. A lower cap 180 provides a stop for the downward axial movement of piston 130. This cap 180 is threadedly connected to the body 106 and to the lower retainer 170 at 182, 184, respectively. Sealing engagement is provided at 586 between the lower cap 180 and the body 106.

A threaded connection is provided at 156 between the upper cap 142 and the inner mandrel 150 and at 158 between the upper cap 142 and body 106. The upper cap 142 sealingly engages the body 106 at 160, and sealingly engages the inner mandrel 150 at 162 and 164.

In operation, drilling fluid flows downwards in flowbore 108 along path 190, through ports 174 in the lower retainer 170 and along path 192 into the piston chamber 132. The differential pressure between the fluid in the flowbore 108 and the fluid in the borehole annulus surrounding tool causes the piston 130 to move axially upwardly from the position shown in FIG. 4 to the position shown in FIG. 5. A portion of the flow can pass through the piston chamber 132 and through nozzles 148 to the annulus as the cutter blocks start to expand. As the piston 130 moves axially upwardly, it urges the drive ring 146 axially upwardly against the blocks 122. The drive ring pushes on all the blocks 122 simultaneously and moves them all axially upwardly in recesses 116 and also radially outwardly as the ribs 150 slide in the channels 118. The blocks 122 are thus driven upwardly and outwardly in unison towards the expanded position shown in FIG. 5.

The movement of the blocks 122 is eventually limited by contact with the spring retainer 140. When the spring 136 is fully compressed against the retainer 140, it acts as a stop and the blocks can travel no further. There is provision for adjustment of the maximum travel of the blocks 122. This adjustment is carried out at the surface before the tool is put into the borehole. The spring retainer 140 connects to the body 106 via a screwthread at 186. A wrench slot 188 is provided between the upper cap 142 and the spring retainer 140, which provides room for a wrench to be inserted to adjust the position of the screwthreaded spring retainer 140 in the body 106. This allows the maximum expanded diameter of the reamer to be set at the surface. The upper cap 142 is also a screwthreaded component and it is used to lock the spring retainer 140 once it has been positioned.

The outer part 126 of each cutter block is a steel structure to which cutters with faces made of a hard material such as tungsten carbide are attached. Referring to the perspective view which is FIG. 6, this steel outer part 126 has a side face 200 which is the leading face in the direction of rotation. An area 204 is slanted back and cutters 211-216 are secured within this area 204. The cutters may comprise a hard material: for instance they may be formed of sintered tungsten carbide.

Figure 8:
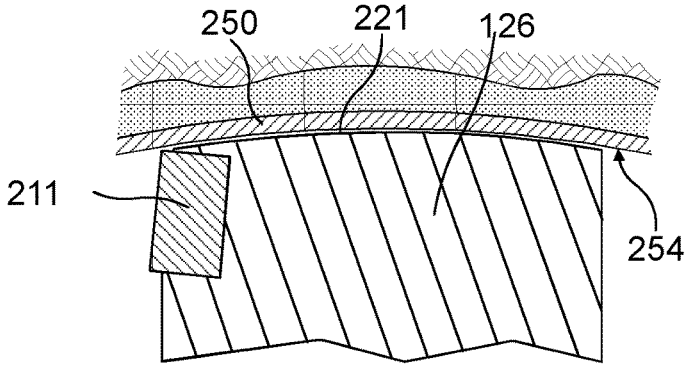
FIG. 8 is a cross section on the line VIII-VIII of FIG. 7.

These cutters may take the form of circular tiles made of sintered tungsten carbide (or other hard material) attached to the area 204 by brazing. Another possibility, illustrated by the cross-section which is FIG. 8, is that the cutters are cylindrical and are secured by brazing in cylindrical pockets formed in the outer block part 126.

The outward facing surface of the outer block part 126 comprises a part-cylindrical outward facing surface 221 with a radius such that the surface 221 is centered on the tool axis when the cutter blocks are fully extended. The cutter 211 is positioned so that its radially outer extremity is at the same distance from the tool axis as the surface 221. Thus, the radial extremity of the cutter 211 is aligned with the edge 218 of the surface 221. There is also a part-cylindrical outward facing surface 222 which is further out from the tool axis and again is centered on the tool axis when the cutter blocks are fully extended. The extremity of cutter 212 is at the same distance from the tool axis as the surface 222. This pattern of a cutter and a part-cylindrical outward facing surface where the surface and the radial extremity of the cutter are both at the same distance from the tool axis is repeated along the block by cutter 213 and surface 223, cutter 214 and surface 224 and so on at progressively greater radial distances from the tool axis. Transitional surfaces 228 connecting adjacent surfaces 221 and 222, similarly 222 and 223 and so on, have the same curvature as, and are aligned with, the curved edges of cutters 211-216.

Figure 7:
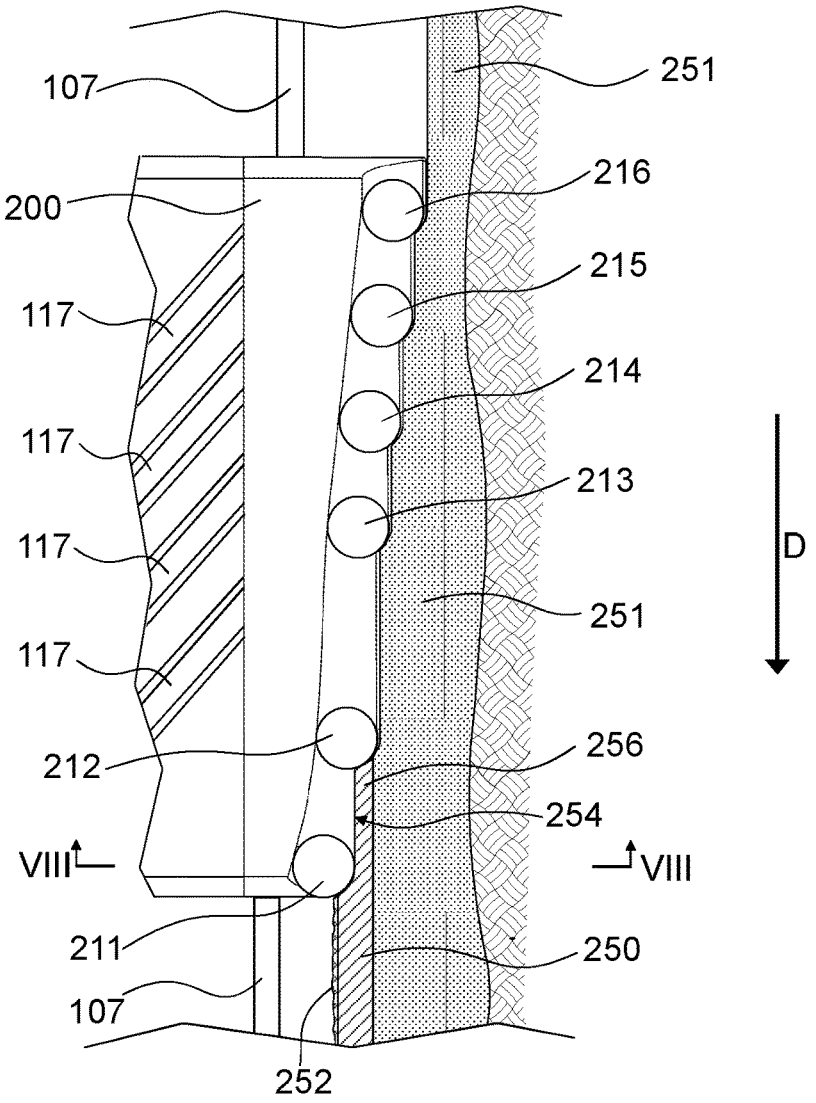
FIG. 7 is a cross sectional elevation showing part of the tool of FIGS. 4 to 6, in use to remove tubing.

FIG. 7 shows the outer part 126 of a cutter block in use to remove tubing 250 within a borehole. There is cement 251 outside the tubing 250 between it and the surrounding rock formation. The tool has already been placed in the borehole and expanded from the tool body while rotating the tool so as to cut into and through the tubing 250. An edge of the outer wall of the tool body 106, exposed at the side of a recess 116, is indicated 107 in FIG. 7. The tool is now advancing axially in the downward direction shown by arrow D. The tubing 250 may have some corrosion and deposited material on its inside surface as depicted schematically at 252. In the fully expanded position of the cutter blocks, the leading cutters 211 on each cutter block are positioned to remove this material 252 and also remove some material from the inside wall of the tubing 250, thus exposing a new inward facing surface 254.

It should be appreciated that the expansion of the cutter blocks by the mechanism within the tool body proceeds as far as the drive mechanism in the tool body will allow. If necessary, the amount of expansion is limited by adjusting the screwthreaded spring retainer 140 in the body 106, using a wrench in the wrench slot 188 while the tool as at the surface so that expansion goes no further than required. The adjustment of expansion is arranged such that when the cutter blocks are fully expanded, the surfaces 221 and the outer extremities of the leading cutters 211 are at a radial distance from the tool axis which is slightly greater than the inner radius of the tubing 250 but less than the outer radius of the tubing. The curvatures of the part-cylindrical outward facing surfaces 221 to 226 are such that each of them is centered on the tool axis when the cutter blocks have been expanded.

The new internal surface 254 is at a uniform radius which is the radial distance from the tool axis to the extremities of the leading cutters 211. Because the part-cylindrical outward facing surfaces 221 of the three blocks have a curvature which is centered on the tool axis and at the same radial distance from the tool axis as the extremities of the leading cutters 211, they are a close fit to this surface 254 created by the cutters 211, as is shown in FIG. 8, and act as guide surfaces which slide over this new internal surface 254 as the tool rotates. The tool axis is thus positioned accurately, relative to the tubing 250. This reduces vibration of the tool as it rotates and cuts compared with a conventional tool whose position in the tubing is less accurately controlled by components in the drill string which are undergauge (i.e. dimensioned to provide clearance between their exterior and the inside surface of the tubing).

As the tool advances axially, the cutters 212 which extend outwardly beyond the surfaces 221 remove the remainder of the tubing indicated at 256 outside the new surface 254 so that the full thickness of the tubing 250 has been removed. The cutters 213 to 216 cut through any cement or other material which was around the outside of the tubing. As shown, some cement outwardly from cutters 216 remains in place. If it is necessary to remove this and expose formation rock, an under-reamer to do this may be included further up the drill string. Alternatively the dimensions may be arranged such that the outermost cutters 216 contact and cut into the formation rock around the borehole.

Because the part-cylindrical surface 221 is centered on the tool axis when the cutter blocks are fully expanded, the tool is configured for removing tubing of a specific internal diameter. However, the tool can be used to remove tubing within a range of internal diameters by preparation at the surface, before it is put into a borehole. The tool is configured by fitting the cutter blocks with outer parts 124 dimensioned so that the radius of curvature of the surface 221 is the same as or slightly larger than the original (i.e. as manufactured) internal radius of the tubing to be removed. Also, at the surface, spring retainer 140 is adjusted, using a wrench in slot 188, so that expansion of the tool is limited to the extent required, at which the cutter s 211 create the new internal surface on line 254 and the surfaces 221 are a close fit against this surface.

Figure 9:
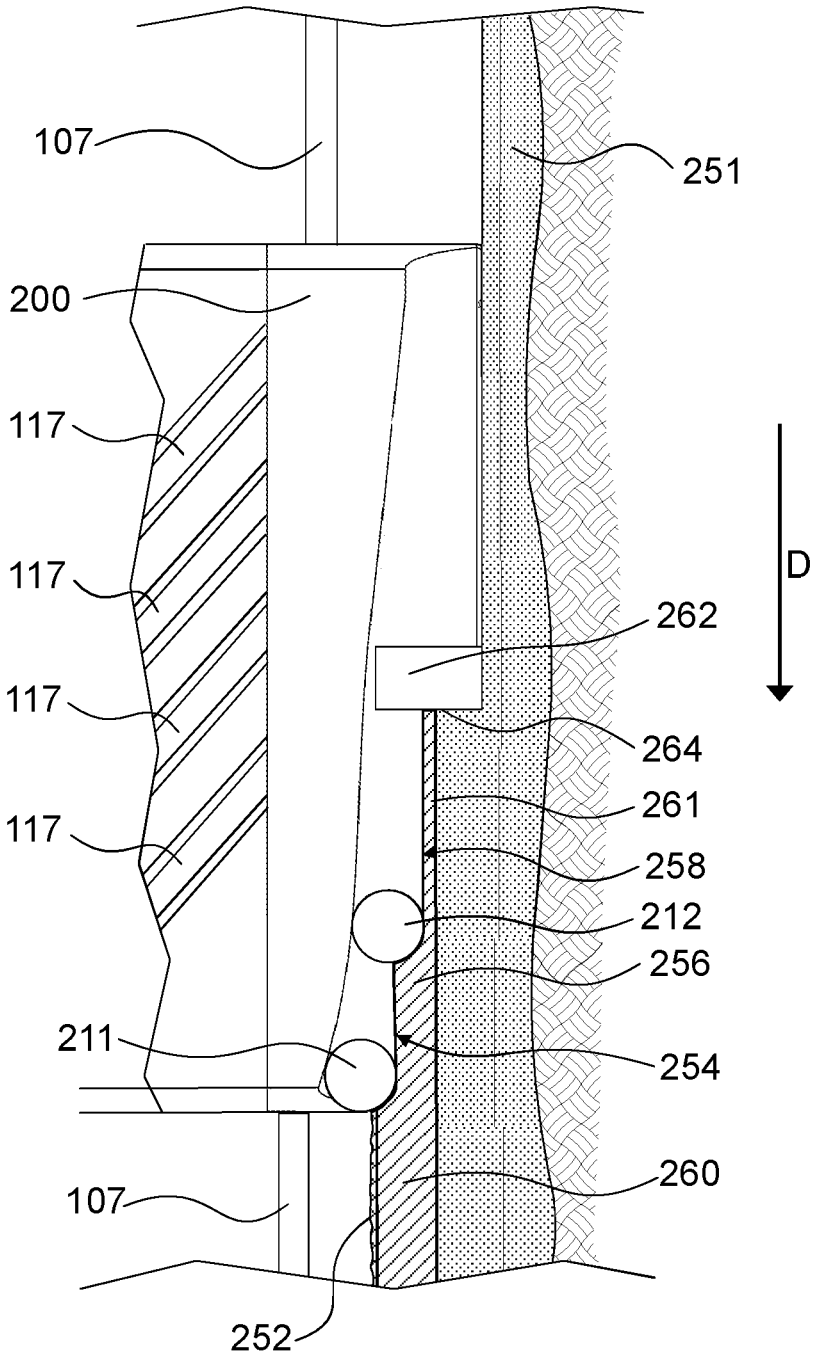
FIG. 9 is a similar view to FIG. 7, showing an arrangement with modifications.

FIG. 9 shows an arrangement which is similar to that in FIG. 7, but with slightly different dimensions and a modification. The tubing 260 is thicker than the tubing 250 seen in FIG. 7. Consequently the cutter 212 removes some metal 256 outwardly from the surface 254 and creates another surface 258. The surfaces 222 of the cutter blocks make sliding contact with this surface 258 and so the tool is positioned by the surfaces 221 and the surfaces 222 both acting as guide surfaces which make sliding contact with the surfaces 254 and 258 respectively. The remaining tubing 261 outwardly of the line 258 is removed by the cutter 262.

Like the cutters 211, and 212, this cutter 262 has a surface which faces forwardly in the direction of rotation. However, it is not circular and has a straight cutting edge 264 extending perpendicular to the tool axis at which the remaining tubing material 261 is cut. This is a precaution to assist removal of the entire thickness of the remaining tubing 261. It is possible that the tubing 261 which remains after cutting by the cutters 211 and 212 may be thin and easily deformable so that a following cutter with a curved edge, like the edges of the circular cutters 211 to 216, may push the remaining tubing 261 outwardly rather than cutting it. The straight edge 264 avoids this possibility. A cutter such as cutter 262 may also be used on the cutter block shown in FIG. 7, in place of its cutter 212.

Figure 10:
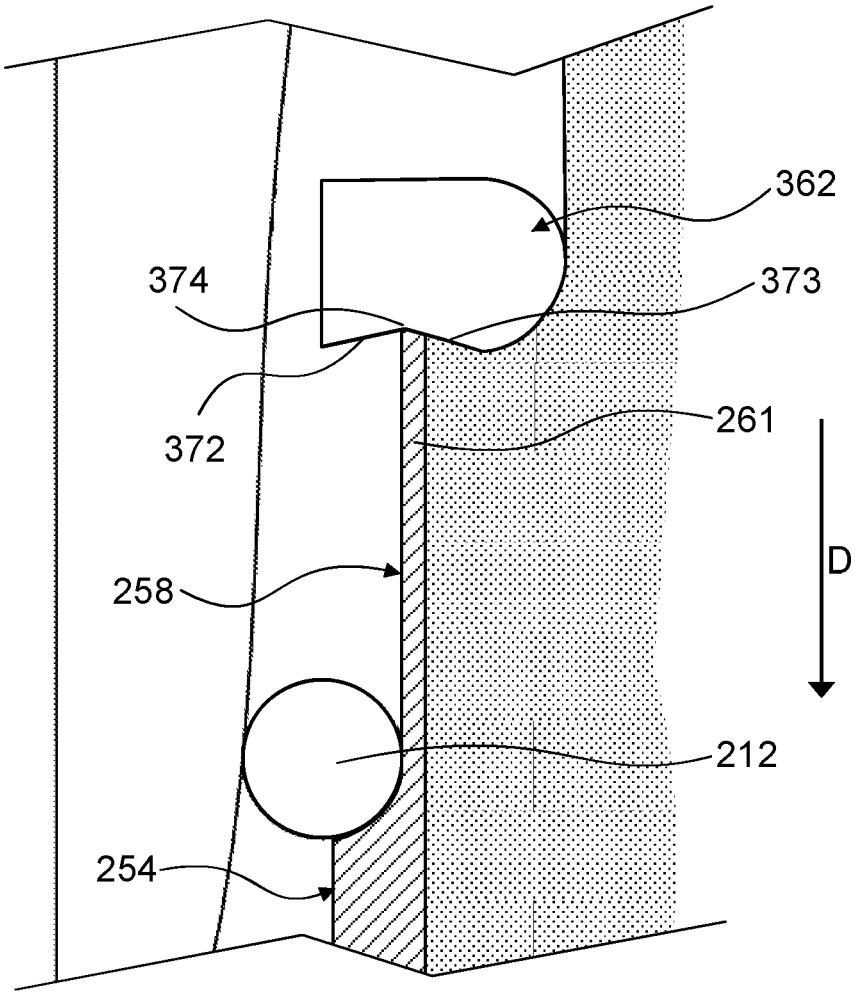
FIG. 10 is an enlargement of part of FIG. 9, showing a different cutter.

FIG. 10 shows an arrangement which is similar to that in FIG. 9, but with the cutter 262 replaced by a cutter 362 in which the cutting edge includes two parts 372 and 373 which are inclined and meet at 374. While the tool is being expanded, the radially outer part of the cutter 362, which has a curved edge, cuts through the tubing 250 and into the surrounding cement. Thereafter, when the tool has been expanded and is being advanced in the direction of the arrow D, the part 373 of the cutting edge contacts and removes the remaining material 261 of the tubing 250. Because this part 373 is inclined as shown in FIG. 10 so that its radially outward end is axially forward from the point 374, this part 373 of the cutting edge does not push the remaining tubing material 261 outwardly. On the contrary, it opposes outward displacement of the material 261 by guiding the material 261 towards the point 374 where the cutting edge parts 372 and 373 meet.

Figure 11A:
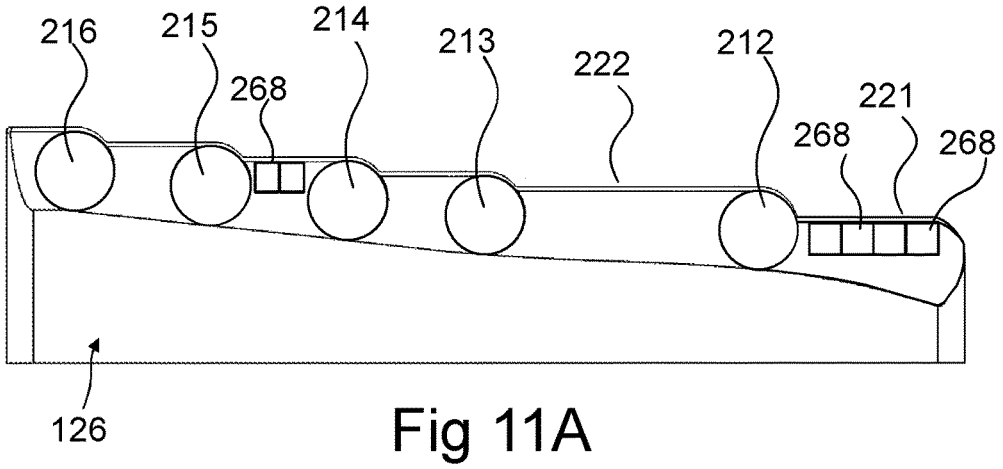
FIGS. 11A, 11B and 11C are side views of the outer part of three cutter blocks used on a variation of the tool of FIGS. 4 to 6.
Figure 11B:
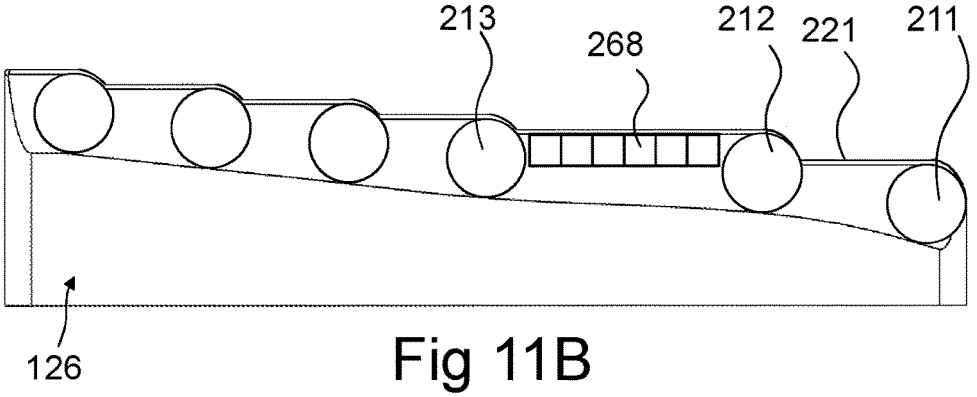
Figure 11C:
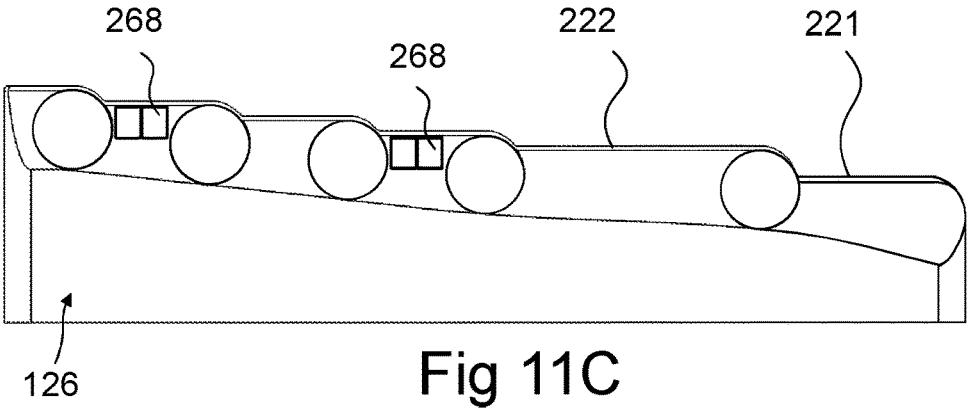

In the tools shown by FIGS. 4 to 10 all three cutter blocks have outer block parts 126 which are identical to each other. However, they may have some differences and FIGS. 11A to 11C show a possible variation from the block shown in FIG. 7. The outer parts 126 of the three blocks have the same dimensions but differ in the cutters provided on them. On one outer block part, shown in FIG. 11A, cutters in the form of square tiles 268 are positioned axially ahead of the cutters 212 and further tiles 268 are positioned between cutters 214 and 215. The cutter 211 is not present on this block part.

On the outer block part shown in FIG. 11B there are similar tiles 268 between cutters 212 and 213. On the third outer block part there are similar tiles between cutters 213 and 214 and between cutters 215 and 216. Again the cutter 211 is not present on this block part. These cutting tiles 268 function to cut into and through the tubing during the stage schematically illustrated by FIG. 2 in which the expanding cutter blocks are cutting outwards through the tubing. It is not necessary to provide these tiles 268 at identical positions on all three cutter blocks. FIGS. 11A and 11C also illustrates the possibility that the cutters 211-216 which remove tubing as the tool advances axially may not be configured to be identical on all cutter blocks.

Although the leading cutter 211 is absent from the blocks in FIGS. 11A and 11C the removal of some material from the tubing and the creation of the new surface on line 254 as shown in FIG. 7 is carried out by the cutter 211 on the outer block part shown in FIG. 11B. Although the cutters 268 are mentioned here is tiles, which may be attached to surface 204 by brazing, it is possible that cutters at these positions may be partially embedded in sockets in the outer cutter block parts 126.

Figure 12:
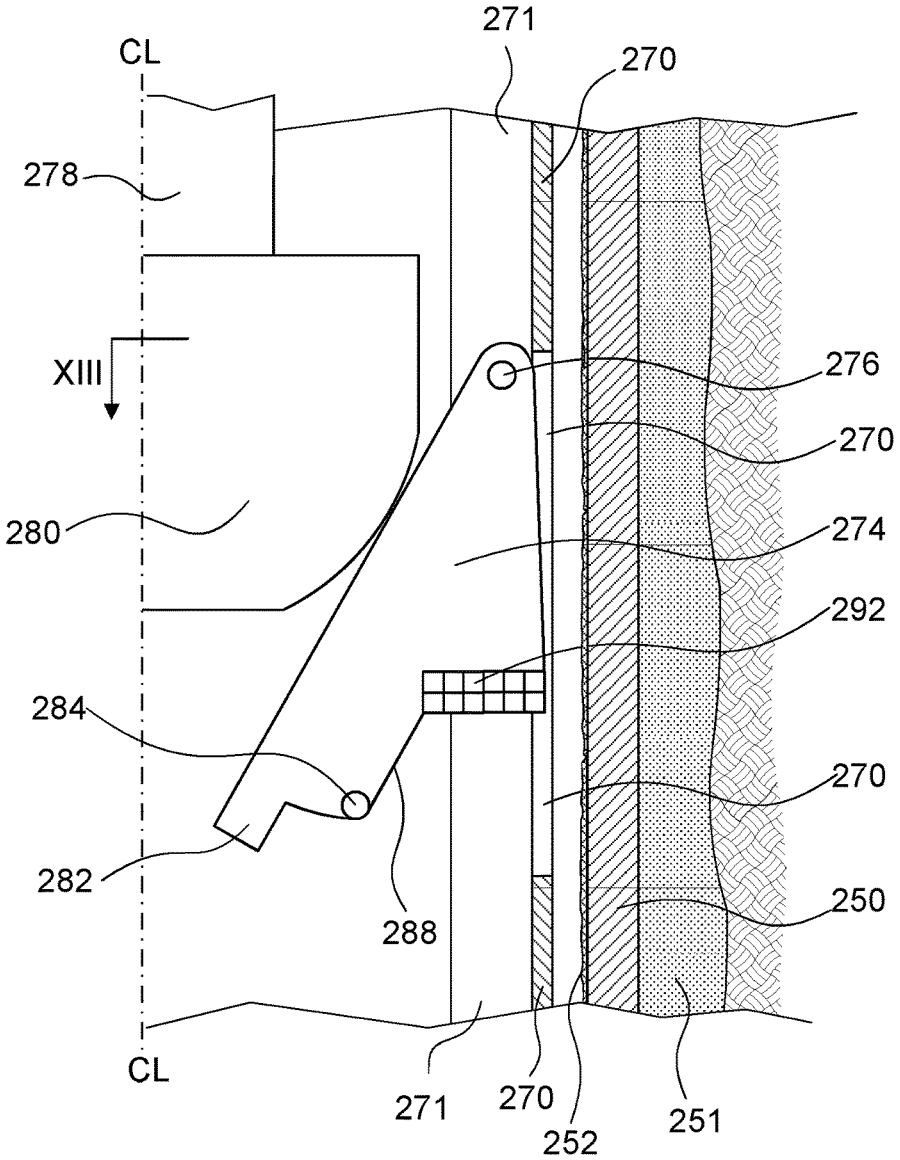
FIG. 12 is a cross sectional elevation of part of a different tool in accordance with embodiments of the present disclosure.
Figure 13:
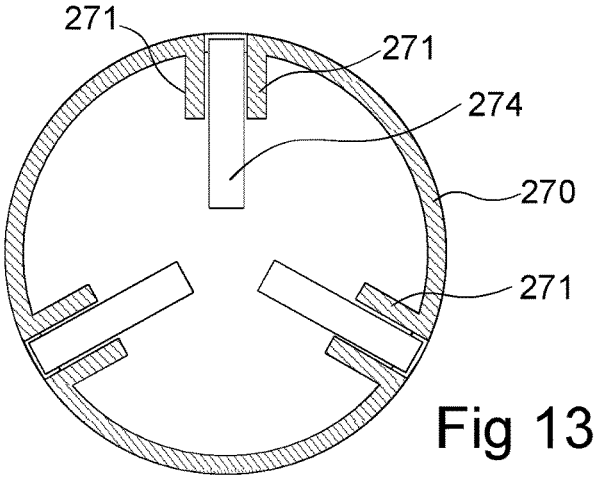
FIG. 13 is a cross section through the tool of FIG. 12.

FIGS. 12 to 15 show tools implementing the same general concepts as the tool of FIGS. 4 to 8, but using cutters on arms which are expanded by a pivoting motion. FIG. 13 is a cross-sectional elevation showing part of the tool to the right of chain dotted centre line CL-CL of FIG. 12. FIG. 13 is a schematic cross section looking along the tool axis at the level of the arrow XIII in FIG. 12, with plunger head 280 omitted. As shown by FIG. 13, the tool has a cylindrical body with an outer wall 270. Three slots are formed in this body at the same axial position and distributed azimuthally around the tool axis.

At either side of each slot there is a plate 272 extending inwardly from the wall 270. An expandable arm 274, formed of steel plate, is accommodated within each slot. As can be seen from FIG. 12, each arm 274 is pivoted to swing around a pin 276 supported by the plates 272 from a retracted position shown in FIG. 12 to an expanded position shown in FIG. 14. Expansion is brought about by a hydraulic cylinder and piston, not shown, operated by pressure of drilling fluid and connected to drive plunger shaft 278. Pressure of drilling fluid causes the plunger shaft 278 to move downwardly. A domed plunger head 280 on the end of shaft 278 acts of the inside edges of arms 274, forcing the arms to pivot outwardly to the position shown in FIG. 14. Outward expansion is limited by projections 282 on the arms 274 when these projections abut the inside face of the tool wall 270.

Figure 14:
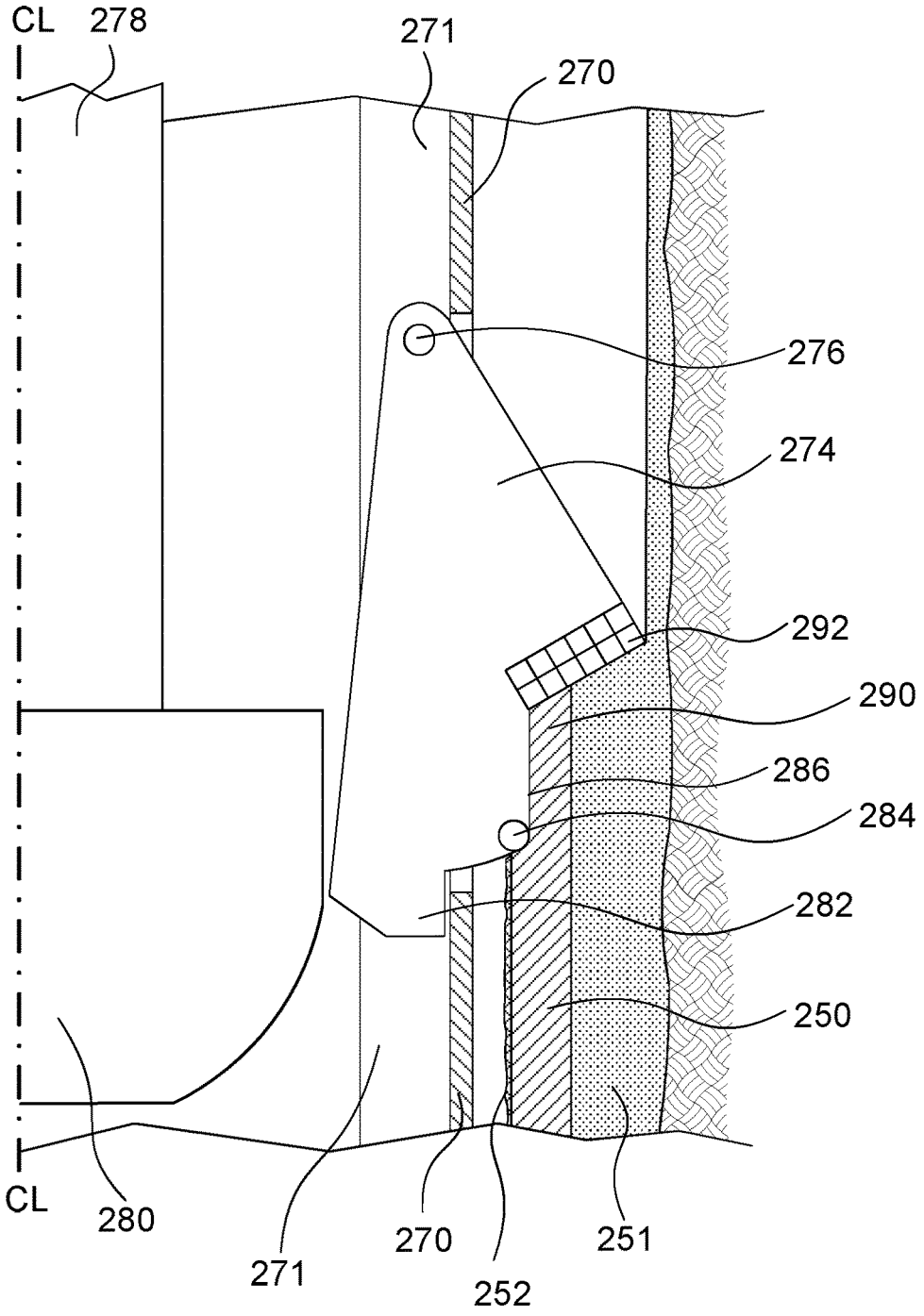
FIG. 14 is a similar view to FIG. 12, with the tool in use to remove tubing.

FIG. 14 shows the tool after it has been fully expanded and is being advanced axially downwards. A cutter 284 made of hard material on each arm 274 is removing corrosion and deposited material 252 on the inside surface of tubing 250 and is also removing some metal, creating a new surface on the line 286. An edge surface 288 (indicated in FIG. 12) on each arm 274 acts as a guide surface making sliding contact with the newly created surface on the line 286. As before this close contact between the guide surfaces 288 and the newly created surface on the tubing gives good stabilization of the tool axis relative to the tubing. Metal 290 which is outside the line 286 is removed by square cutters 292 also made of hard material and positioned as tiles on the arm 274. These cutters 292 also remove some of the cement 251 around the tubing 250.

Figure 15:
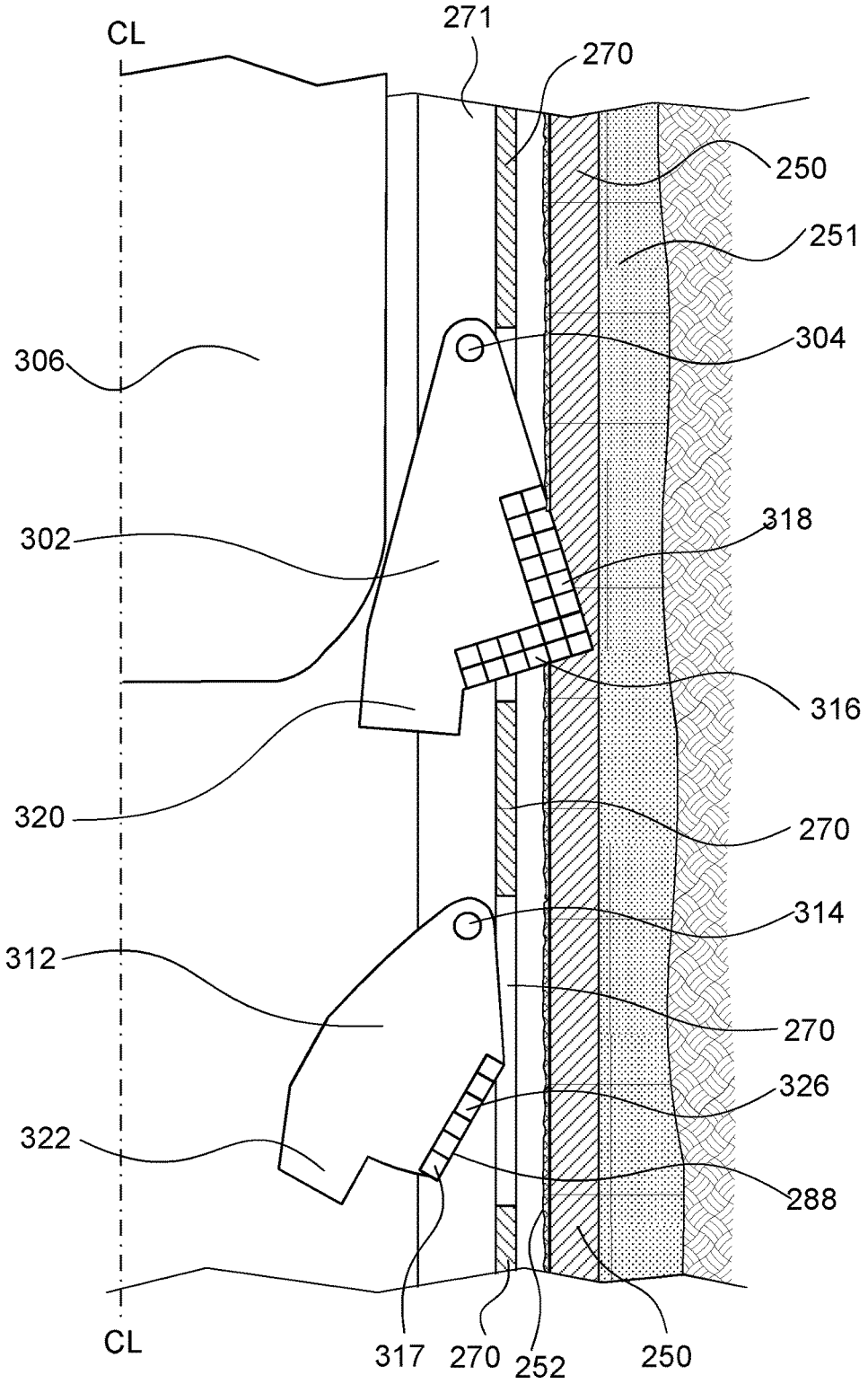
FIG. 15 is a cross sectional elevation of part of a further tool, in accordance with embodiments of the present disclosure.

FIG. 15 shows another tool which has similarity to the tool of FIGS. 12 to 14, but has the cutters on two sets of expandable arms. Where the component parts are the same as in FIGS. 12 to 14, the same reference numerals are used. The three arms in each set are at the same axial position and distributed azimuthally around the tool body. Each arm 302 in the upper set is pivoted around a pin 304 and can be expanded outwardly by a plunger 306 which has a domed end and a cylindrical portion which is longer than in the plunger head 280 of FIG. 12. The arm 302 of the upper set carries a number of cutters made of hard material and arranged as an L-shaped array of square tiles with a part 316 extending along an axially forward facing edge of the arm and a part 318 extending along an outward facing edge of the arm 302. Each arm 312 in the lower set is pivoted around a pin 314 and can be expanded outwardly by the plunger 306 when this descends sufficiently far. As shown in FIG. 15, the arm 312 has an edge 288 which provides a guide surface. Alongside this edge there are hard cutters 326 shaped as square tiles. The leading tile is indicated at 327.

Thus, this tool has the guide surface 288 and the leading cutter 327 on the lower set of three expandable arms 312 and the further cutters 316 on the upper set of arms 302. For use, the tool is initially inserted into tubing with all arms retracted. At the place where the removal of tubing is to begin, the tool is rotated and drilling fluid is pumped down to the tool. The plunger 306 begins to descend and expands the upper set of arms 302. FIG. 15 shows these arms partially expanded so that some of the cutters 318 are beginning to cut into the tubing. At the stage shown, the plunger 306 cannot descend beyond the arms 302 because they have not yet been fully expanded. Outward expansion is limited by projections 320 on the arms 302 when these projections abut the inside face of the tool wall 270.

The lower arms 312 therefore remain retracted. When the arms 302 and the cutters 318 on them have cut through the tubing and out into the cement to reach their fully expanded position, the plunger 306 descends further and expands the arms 312. The cutters 326 on the lower arms 312 cut out into the tubing 250 until the lower arms are fully expanded. Expansion is limited by the projection 322 on each arm 312 abutting the inside face of the tool wall 270.

The tool is next advanced axially downwards and operates in a manner very similar to that illustrated by FIG. 14. The leading cutter 327 on each lower arm 302 removes corrosion and deposits 252 from the tubing and also removes some metal from the inside face of the tubing, thus creating a new surface. The guide surfaces 288 on the arms 312 make sliding contact with this newly created surface. Metal outside this surface is removed by the cutters 316 on the upper arms 302.

It will be appreciated that the embodiments and examples described in detail above can be modified and varied within the scope of the concepts which they exemplify. Features referred to above or shown in individual embodiments above may be used together in any combination as well as those which have been shown and described specifically. More particularly, where features were mentioned above in combinations, details of a feature used in one combination may be used in another combination where the same feature is mentioned. Accordingly, all such modifications are intended to be included within the scope of this disclosure as defined in the following claims.

The invention claimed is:

1. A milling tool for comminuting tubing in a borehole, comprising: a tool body; a plurality of elements projecting from or extensible from the tool body and distributed azimuthally around a longitudinal axis of the tool body wherein: at least some of the elements comprise outward facing guide surfaces configured to provide a sliding contact with an inward facing surface of the tubing; and at least some of the elements comprise one or more cutters to remove material from the tubing, wherein the cutters and guide surfaces are configured such that: a plurality of the outward facing guide surfaces are distributed azimuthally around the tool axis, the plurality of guide surfaces including a first plurality of guide surfaces extending to a first radius and a second plurality of guide surfaces extending to a second radius which is greater than the first radius, wherein the second plurality of guide surfaces are at positions axially behind the first plurality of guide surfaces;

at least one cutter is at an axial position which is at least as far forward in the direction of advance of the tool as axially leading parts of the first plurality of guide surfaces and extends radially outward from the tool axis to the same distance as the first plurality of guide surfaces, and at least one further cutter is positioned axially behind the first plurality of guide surfaces and axially ahead of the second plurality of guide surfaces and extends radially outward beyond the first plurality of guide surfaces to the second radius, wherein the difference between the first radius and the second radius is less than a diameter of the at least one further cutter, and a plurality of further trailing cutters are positioned axially behind the second plurality of guide surfaces and which extend radially outward beyond the second plurality of guide surfaces.

2. The milling tool of claim 1 having at least three elements projecting from or extensible from the tool body at the same axial position, distributed azimuthally around the tool axis, and each having an outwardly facing guide surface.

3. The milling tool of claim 1 wherein a plurality of the plurality of azimuthally distributed extensible elements each have an outwardly facing guide surface, at least one leading cutter ahead of the guide surface, and at least one further cutter axially behind the guide surface.

4. The milling tool of claim 1 having extensible elements which are pivotally attached to the tool body and are extendable by pivoting outwardly from the tool body.

5. The milling tool of claim 1 having extensible elements movable outwardly from the tool body while maintaining their orientation relative to the tool body.

6. The milling tool of claim 1 having at least three extensible elements and further comprising a drive mechanism configured to extend the at least three extensible elements outwardly from the tool body in unison.

7. The milling tool of claim 1, wherein at least some of the elements include a rotationally leading edge on which the at least one cutter and the at least one further cutter are positioned.

8. The milling tool of claim 7, at least some of the elements including a third guide surface, where the rotationally leading edge includes a single first cutter of the one or more cutters axially between the first and second guide surfaces, and the at least one further cutter comprises a single second cutter axially between the second and third guide surfaces.

9. A method of removing a length of tubing in a borehole, comprising: inserting into the tubing a rotary milling tool comprising a tool body and a plurality of elements projecting from or extensible from the tool body and distributed azimuthally around a longitudinal axis of the tool body, wherein: at least some of the elements comprise outward facing guide surfaces for producing a sliding contact with an inward facing surface of the tubing, the outward facing guide surfaces including a first plurality of outward facing guide surfaces extending to a first radius and a second plurality of outward facing guide surfaces extending to a second radius which is greater than the first radius, wherein the second plurality of guide surfaces are at positions axially behind the first plurality of guide surfaces; and at least some of the elements comprise one or more cutters to remove material from the tubing, configured with at least one of the one or more cutters at an axial position which is at least as far forward in a direction of advance of the tool as leading axial parts of the first plurality of outward facing guide surfaces and at least one further cutter of the one or more cutters positioned axially behind the first plurality of outward facing guide surfaces;

advancing the tool axially while rotating the tool with the elements extending from the tool body to provide for:

contacting an interior surface of the tubing with the at least one leading cutter, to remove material from the interior surface of the tubing and expose an interior tubing surface with diameter swept out by the at least one cutter, slidingly contacting the interior tubing surface with the first plurality of the outward facing guide surfaces on a plurality of azimuthally distributed elements, and removing the tubing with the interior tubing surface by cutting it with the at least one further cutter as the tool advances, the at least one further cutter positioned axially ahead of the second plurality of guide surfaces extending radially outward beyond the first plurality of outward facing guide surfaces to the second radius, wherein the difference between the first radius and the second radius is less than a diameter of the at least one further cutter, and a plurality of further trailing cutters are positioned axially behind the second plurality of guide surfaces and which extend radially outward beyond the second plurality of guide surfaces.

10. The method of claim 9 wherein the at least one leading cutter removes metal from the interior of the tubing and thereby reduces a thickness of the tubing while exposing a new interior surface on remaining tubing of reduced thickness.

11. The method of claim 10 wherein the at least one further cutter removes metal from the interior of the remaining tubing and thereby further reduces the thickness of the tubing while exposing a new interior surface on remaining tubing of further reduced thickness.

12. The method of claim 9 wherein the at least one further cutter is shaped to remove all the remaining tubing while resisting radial outward movement of the remaining tubing.

13. The method of claim 9 wherein the at least one further cutter also removes non-metallic material surrounding an exterior of the tubing.

14. The method of claim 9, further comprising subsequently plugging the borehole at the position where tubing has been removed.

15. A milling tool for comminuting tubing in a borehole, comprising:

a tool body configured for rotating and advancing along the tubing to mill the tubing; and a plurality of milling blocks disposed circumferentially around the tool body, wherein each of the plurality of milling blocks has a forward end and a rear end and comprises: one or more axially leading cutters disposed towards the forward end of the milling block and extending laterally from the milling block to a first radius and configured in use to provide for cutting a portion of the tubing to produce an inward facing surface of the tubing; a first plurality of outward facing guide surfaces disposed between the one or more axially leading cutters and the rear end of the milling block comprising a surface extending to a the first radius and configured in use to provide a sliding contact with the inward facing surface, a second plurality of outward facing guide surfaces extending to a second radius which is greater than the first radius and configured in use to provide a sliding contact with tubing, wherein the second plurality of guide surfaces are at positions axially behind the first plurality of guide surfaces; and one or more axially trailing cutters positioned axially between the first plurality of outward facing guide surfaces and the second plurality of outward facing guide surfaces and extending radially outward from the milling block beyond the first plurality of outward facing guide surfaces and configured in use to produce a trailing cutting silhouette that extends to the second radius, wherein the difference between the first radius and the second radius is less than a diameter of the at least one further cutter, and a plurality of further trailing cutters are positioned axially behind the second plurality of guide surfaces and which extend radially outward beyond the second plurality of guide surfaces.

* * * * *